US009011084B2

(12) United States Patent
Ono et al.

(10) Patent No.: US 9,011,084 B2
(45) Date of Patent: Apr. 21, 2015

(54) STEAM TURBINE STATOR VANE AND STEAM TURBINE USING THE SAME

(75) Inventors: Hideki Ono, Mito (JP); Kenichi Murata, Hitachi (JP); Shigeki Senoo, Hitachi (JP); Goingwon Lee, Hitachi (JP)

(73) Assignee: Mitsubishi Hitachi Power Systems, Ltd., Kanagawa (JP)

( * ) Notice: Subject to any disclaimer, the term of this patent is extended or adjusted under 35 U.S.C. 154(b) by 637 days.

(21) Appl. No.: 13/231,860

(22) Filed: Sep. 13, 2011

(65) Prior Publication Data

US 2012/0076646 A1 Mar. 29, 2012

(30) Foreign Application Priority Data

Sep. 28, 2010 (JP) ..... 2010-216336

(51) Int. Cl.
*F01D 9/02* (2006.01)
*F01D 5/14* (2006.01)

(52) U.S. Cl.
CPC ..... *F01D 5/141* (2013.01); *F05D 2220/31* (2013.01); *F05D 2240/121* (2013.01); *F05D 2240/122* (2013.01); *F05D 2250/711* (2013.01); *F05D 2250/713* (2013.01)

(58) Field of Classification Search
USPC ..... 415/181
See application file for complete search history.

(56) References Cited

U.S. PATENT DOCUMENTS 4,470,755 A * 9/1984 Bessay ..... 415/191
4,616,975 A * 10/1986 Duncan ..... 415/181
6,099,248 A 8/2000 Mumm et al.
7,429,161 B2 * 9/2008 Senoo et al. ..... 415/191
7,806,653 B2 * 10/2010 Burton et al. ..... 415/191
2006/0222482 A1 10/2006 Jacks
2007/0071606 A1 3/2007 Borthwick et al.
2009/0123276 A1 5/2009 Greim et al.

FOREIGN PATENT DOCUMENTS

EP 2 075 408 A2 7/2009
JP 6-193402 A 7/1994
JP 10-131707 A 5/1998

(Continued)

OTHER PUBLICATIONS

Korean Office Action dated May 27, 2013 (ten (10) pages).
Japanese-language Office Action dated Dec. 24, 2013 (three (3) pages).

(Continued)

*Primary Examiner* — Nathaniel Wiehe
*Assistant Examiner* — Brian O Peters
(74) *Attorney, Agent, or Firm* — Crowell & Moring LLP

(57) ABSTRACT

Suppressing profile loss of a moving blade due to radial flow without an increase in the length of a shaft of a turbine is disclosed. The degree of reaction on an inner circumferential side is set to an appropriate degree, reducing profile loss due to supersonic inflow, and improving turbine efficiency. A steam turbine stator vane has a trailing edge with a curved line when the stator vane is viewed from a downstream side in the axial direction. The curved line has an inflection point located on an outer circumferential side with respect to the center of the stator vane in the height direction of the stator vane. An inner circumferential portion of the curved line is located on the inner circumferential side with respect to the inflection point. An outer circumferential portion of the curved line is located on the outer circumferential side with respect to the inflection point.

19 Claims, 8 Drawing Sheets

(56) References Cited

FOREIGN PATENT DOCUMENTS

| | | | |
|---|---|---|---|
| JP | 2000-248903 | A | 9/2000 |
| JP | 2002-54401 | A | 2/2002 |
| JP | 2003-27901 | A | 1/2003 |
| JP | 2006-283764 | A | 10/2006 |
| JP | 2007-127132 | A | 5/2007 |
| JP | 2009-121468 | A | 6/2009 |
| WO | WO 2005/005784 | A1 | 1/2005 |

OTHER PUBLICATIONS

Sigg et al., "The Influence of Lean and Sweep in a Low Pressure Steam Turbine: Analysis of Three Stages with a 3D CFD Model", Proceedings of ASME Turbo Expo 2008: Power for Land, Sea, and Air, GT2008, Jun. 9-13, 2008, Berlin, Germany (five (5) sheets).

Stüer et al., "Aerodynamic Concept for Very Large Steam Turbine Last Stages", Proceedings of GT2005 ASME Turbo Expo 2005: Power for Land, Sea, and Air, Jun. 6-9, 2005, Reno-Tahoe, Nevada, USA (three (3) sheets).

* cited by examiner

STEAM TURBINE STATOR VANE AND STEAM TURBINE USING THE SAME

BACKGROUND OF THE INVENTION

1. Field of the Invention

The present invention relates to a steam turbine stator vane.

2. Description of the Related Art

In general, a steam turbine has a plurality of stages that are each constituted by stator vanes and moving blades, while the stages are arranged in the axial direction of a turbine rotor. An exhaust hood is installed on the downstream side of the steam turbine. Steam that is a working fluid is accelerated by stator vanes that serve as a convergent passage so that kinetic energy of the steam is increased. The kinetic energy is converted into rotational energy by moving blades so that power is generated.

In the steam turbine, when the lengths of the turbine blades located at a last stage of a low-pressure turbine are increased, the area of a passage through which steam flows is increased, and the kinetic energy of the steam is reduced. Thus, kinetic energy that is not used for generation of power and is exhausted is reduced, and the turbine efficiency is improved.

However, when the lengths of the blades located at the last stage are increased, the following problems occur.

The first problem is a reduction in the efficiency due to a reduction in the degree of reaction. When the lengths of the blades of the turbine are increased, a spreading angle (flare angle) (on the outer circumferential side of the turbine) of the turbine passage through which steam flows increases. When the flare angle increases, a velocity component of steam in a radial direction (of the turbine) at a stator vane outlet increases. The velocity component in the radial direction is increased by centrifugal force of the moving blades. Intervals of an inner circumferential portion of a uniform flow diagram of a two-dimensional passage projected in a plane including a rotational axis increase. As a result, in an inner circumferential portion of the turbine passage, a substantial passage area that corresponds to the moving blade is larger than a substantial passage area that corresponds to the stator vane. Thus, the degree of reaction, which is the ratio of a reduced amount of pressure at the moving blade to a reduced amount of pressure at the stage, is reduced.

The optimal value of the degree of reaction to maximize the efficiency exists. The turbine blades are designed on the basis of the degree of reaction at which the efficiency becomes maximum. Thus, when the degree of reaction is reduced, the efficiency is reduced.

As methods for increasing the degree of reaction in the inner circumferential portion of the turbine passage and improving the efficiency, a tangential lean that causes the stator vane to be inclined toward a rotational direction of the moving blade with respect to the height direction of the stator vane, and an axial lean that causes the stator vane to be inclined toward the axial direction of the turbine, have been used, as described in U.S. Patent Application No. 2007/0071606. These leans are effective means for changing the degree of reaction. For example, JP-H10-131707-A discloses a technique for setting the degree of reaction to an appropriate degree on the basis of a Bow angle $\gamma$ (that is a parameter of the shape of the tangential lean) and the ratio of a projecting amount on a tip side to a pitch on an inner circumferential side. In addition, European Patent Application No. 2075408, U.S. Pat. No. 6,099,248, JP-2009-121468-A and International Publication No. 2005/005784 each disclose a technique for adjusting the degree of reaction to an appropriate degree by means of a combination of a tangential lean and an axial lean.

The second problem with the increases in the lengths of the blades is an increase in a profile loss. This is attributable to the occurrence of a shock wave that is caused by the fact that the flow of steam into a region in which the moving blades rotate on the outer circumferential side of the moving blades is supersonic.

In a general turbine stage, when the length of the moving blade is increased, and a moving blade outer circumferential end portion Mach number, which is obtained by dividing a rotational circumferential velocity of an outer circumferential inlet portion of the moving blade by a velocity of sound in the steam flowing into a region in which an outer circumferential end portion of the moving blade rotates, exceeds 1.0, there is a possibility that a relative velocity (moving blade relative inflow velocity) of the steam flowing into a region (in which the moving blade rotates) to the rotational velocity of the moving blade may be a supersonic velocity.

When the moving blade relative inflow velocity reaches a supersonic velocity, the flow of the steam on the upstream side of the moving blade is choked. Thus, the flow rate of the steam cannot be determined on the basis of a throat (minimum distance between moving blades that are adjacent to each other in a circumferential direction of the turbine), and designed flow of the steam cannot be achieved. In addition, a large profile loss may occur due to formation of a detached shock wave on the upstream side of a leading edge of the moving blade and interference between the detached shock wave and a blade surface boundary layer.

As described above, when the length of the moving blade of the general turbine stage is increased, the moving blade relative inflow velocity reaches a supersonic velocity, and performance of the turbine stage may be significantly reduced.

As a method for suppressing a profile loss due to supersonic inflow of steam, JP-2003-27901-A discloses a turbine provided with a turbine passage having a specific shape.

SUMMARY OF THE INVENTION

As described above, when the flare angle is increased and the degree of reaction is reduced, the stage efficiency is reduced. In addition, when the flare angle is increased, the steam three-dimensionally flows from a midspan of the blade to an outer circumferential portion of the blade and has a velocity component in the radial direction. The radial three-dimensional flow causes an increase in a profile loss of the blade and a reduction in the efficiency. In fact, as the flare angle on a tip side is larger, a reduction in the efficiency is larger (refer to a solid line illustrated in FIG. 3).

Even when a turbine passage has a shape with such a tangential lean or an axial lean as described in U.S. Patent Application No. 2007/0071606, JP-H10-131707-A, European Patent Application No. 2075408, U.S. Pat. No. 6,099,248, JP-2009-121468-A and International Publication No. 2005/005784 and a large flare angle (for example, approximately 50°), the degree of reaction on the inner circumferential side can be increased and set to a designed value.

However, when the degree of reaction on the inner circumferential side is approximately set to a designed value in a turbine passage having a large flare angle, the steam three-dimensionally flows and has a velocity component in the radial direction in the turbine stage due to the flare angle on the outer circumferential side, and the efficiency (refer to a broken line illustrated in FIG. 3) is lower than a turbine passage that has a small flare angle (for example, approximately 30°) and in which the degree of reaction on the inner circumferential side is approximately set to a designed value. In order to approximately set the degree of reaction on the inner circumferential side to the designed value and thereby improve the efficiency, it is necessary that the flare angle on the tip side be not large.

When the length of the blade is increased and a tangential lean is simply provided, the efficiency cannot be increased to a desired efficiency.

In order to reduce the flare angle on the tip side, a distance between stages is increased. However, when the distance between the stages is increased, the length of a shaft of the turbine is increased. This may cause a reduction in the rigidity of the rotor and an increase in the cost of the entire plant.

When the length of the moving blade is increased, steam flows into a region (in which an outer circumferential portion of the moving blade rotates) at a relatively supersonic velocity, and a profile loss of the moving blade may be increased by the occurrence of a shock wave. JP-2003-27901-A describes the shape of the turbine passage as a method for suppressing the supersonic inflow, but does not describe a tangential lean and axial lean of a nozzle.

An object of the present invention is to provide a steam turbine stator vane that is capable of improving a flow pattern in a radial direction of a turbine while the length of a blade is large, suppressing a reduction in the degree of reaction in an inner circumferential portion of a turbine passage, suppressing a profile loss of the blade due to radial flow without an increase in the length of a shaft of the turbine, reducing a profile loss due to supersonic flow into a region of a rotation of the moving blade, and improving the turbine efficiency.

To accomplish the object, a curved line of a trailing edge of the stator vane when the stator vane is viewed from the downstream side in the axial direction has an inflection point, a projecting amount of the curved line in a rotational direction of a moving blade of the steam turbine continuously increases from the root portion of the stator vane to the tip portion of the stator vane. A tip portion of the stator vane is inclined toward the outer circumferential side of the steam turbine with respect to flow direction of a working fluid from the upstream side of flow of the working fluid. A root portion of the stator vane is inclined toward the inner circumferential side of the steam turbine from a position at which the width of an inter-vane flow path formed between the stator vane and another stator vane is minimal to the downstream side of the flow direction of the working fluid, the stator vanes being arranged adjacent to each other in a circumferential direction of the steam turbine.

According to the present invention, it is possible to improve the flow pattern in the radial direction while the length of the moving blade is increased, suppress a reduction in the degree of reaction in the inner circumferential portion of the turbine passage, suppress a profile loss of the moving blade due to the radial flow without an increase in the length of the shaft of the turbine, and improve the turbine efficiency.

DESCRIPTION OF THE PREFERRED EMBODIMENT

Embodiments of the present invention are described in detail below with reference to the accompanying drawings.

First Embodiment

A first embodiment of the present invention is described below. The present embodiment applies to a last stage of a low-pressure turbine. However, the embodiment is not limited to the last stage of the low-pressure turbine.

Figure 1:
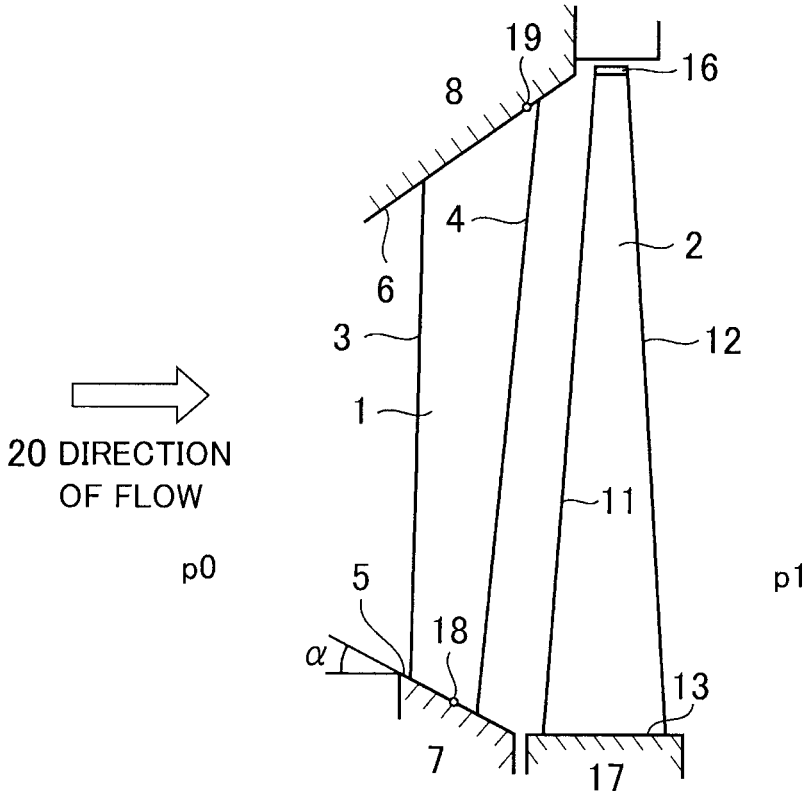
FIG. 1 is a meridian cross-sectional view of a main structure of a turbine stage according to a first embodiment of the present invention.

FIG. 1 is a meridian cross-sectional view of a main structure of a turbine stage according to the present embodiment. As illustrated in FIG. 1, the turbine stage that is included in a steam turbine is located between a high-pressure section p0 arranged on the upstream side (hereinafter merely referred to as upstream side) of flow of a working fluid in a steam passage and a low-pressure section p1 located on the downstream side (hereinafter merely referred to as downstream side) of the flow of the working fluid in the steam passage. The turbine stage includes a stator vane 1 and a moving blade 2. The stator vane 1 is installed and fixed between an outer circumferential side stator vane stationary portion 8 and an inner circumferential side stator vane stationary portion 7. The moving blade 2 is mounted on a turbine rotor 17 that rotates around a central shaft. The steam turbine has a plurality of turbine stages arranged in the direction of flow (indicated by an arrow 20 of FIG. 1) of the working fluid. In each of the stages, the moving blade 2 faces the stator vane 1 and is located on the downstream side of the stator vane 1.

A plurality of stator vanes 1 are installed in the turbine and arranged in a circumferential direction of the turbine. Outer circumferential end portions of the stator vanes 1 are held by the outer circumferential side stator vane stationary portion 8. Inner circumferential root portions of the stator vanes 1 are held by the inner circumferential side stator vane stationary portion 7. The steam flows between an inner circumferential side wall surface of the outer circumferential side stator vane stationary portion 8 and an outer circumferential side wall surface of the inner circumferential side stator vane stationary portion 7. The steam is accelerated when the steam flows from a leading edge 3 of the stator vane 1 to a trailing edge 4 of the stator vane 3.

The "outer circumferential side stator vane stationary portion 8" indicates a stationary body (not including the stator vane) that covers the turbine rotor 17 that is a rotating body. For example, when a diaphragm (outer circumferential side diaphragm) is attached to the steam turbine and annularly extends along an inner circumference of a casing, the outer circumferential side diaphragm corresponds to the "outer circumferential side stator vane stationary portion 8". When the outer circumferential side diaphragm is not installed, the casing corresponds to the "outer circumferential side stator vane stationary portion 8". In addition, an inner circumferential side diaphragm is corresponds to the "inner circumferential side stator vane stationary portion 7". The wall surface that is included in the outer circumferential side stator vane stationary portion 8 and connected to the tip portions of the stator vanes 1 is defined as a "outer circumferential side stator vane inner wall 6". The wall surface that is included in the inner circumferential side stator vane stationary portion 7 and connected to the root portions of the stator vanes 1 is defined as an "inner circumferential side stator vane inner wall 5".

A plurality of moving blades 2 are fixed to the turbine rotor 17 and arranged in the circumferential direction of the turbine. A shroud cover 16 is mounted on outer circumferential end portions of the moving blades 2 and connects the plurality of moving blades 2 arranged in the circumferential direction. The shroud cover 16 may be fixed as a single member and provided for the plurality of moving blades 2. The shroud cover 16 may adhere to the moving blades 2 as an integrated cover between pitches of the moving blades.

In the aforementioned configuration, when flow of the steam is induced by the difference between pressures of the sections p0 and p1, the steam is accelerated when the steam flows between the leading edge 3 of the stator vane 1 and the trailing edge 4 of the stator vane 1. In addition, when the steam flows between the leading edge 3 of the stator vane 1 and the trailing edge 4 of the stator vane 1, the direction of the flow of the steam is changed so that the steam flows in the circumferential direction of the turbine. The steam that has a velocity component in the circumferential direction and passes through the stator vane 1 provides energy to the moving blade 2 so as to cause the turbine rotor 17 to rotate.

In the low-pressure turbine, pressure of the steam at an inlet section of the stage is higher than pressure of the steam at an outlet section of the stage, and a specific volume of the steam at the inlet section of the stage is smaller than a specific volume of the steam at the outlet section of the stage. Thus, the height of the passage at inlet section of the stage is smaller than the height of the passage at outlet section of the stage. Thus, the tip portion of the stator vane 1 and the outer circumstantial side stator vane inner wall 6 are linearly (or monotonously) inclined toward the outer circumferential side of the turbine with respect to the direction from the upstream side to the downstream side. For the following description, the inclination angle of the tip portion of the stator vane 1 or the outer circumferential side stator vane inner wall 6 with respect to the axial direction is defined as a flare angle.

Next, a method for forming a tangential lean of the stator vane 1 according to the present embodiment is described. The tangential lean is formed using a trailing edge curved line that indicates the shape of the trailing edge of the stator vane 1 in the present embodiment.

Figure 2:
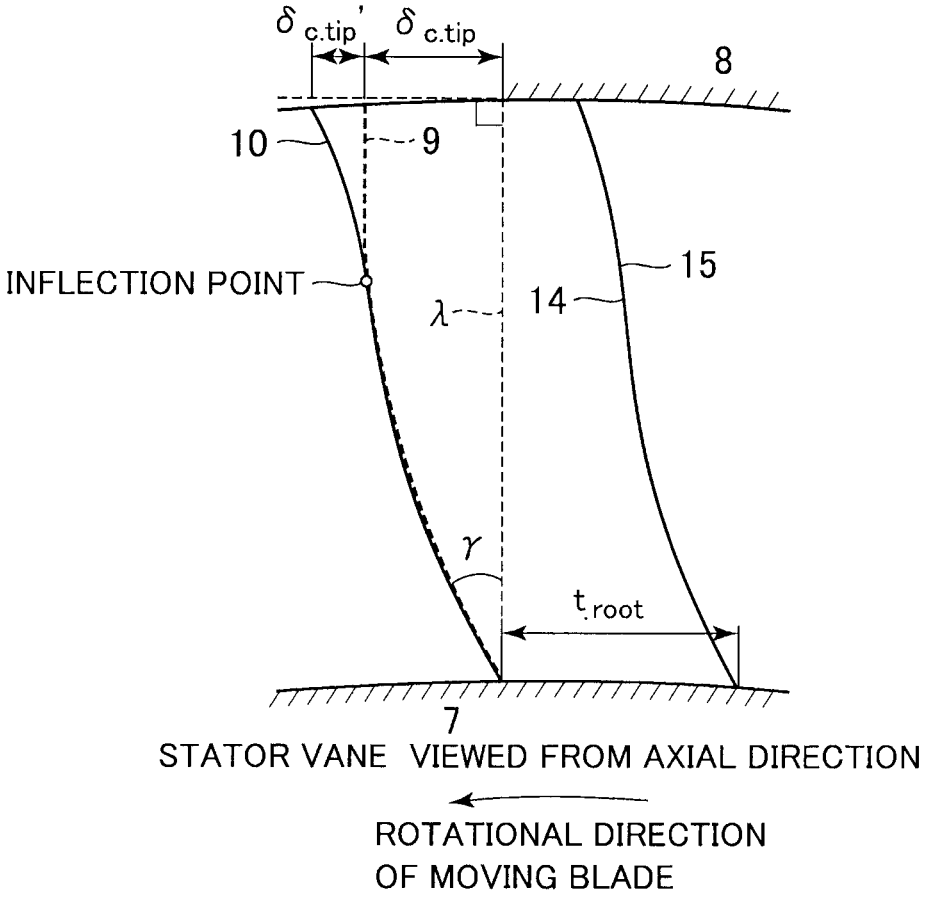
FIG. 2 is a diagram illustrating the shape of a curved line of a trailing edge of a stator vane when the stator vane is viewed from the downstream side in the axial direction of a turbine according to the first embodiment of the present invention.
Figure 3:
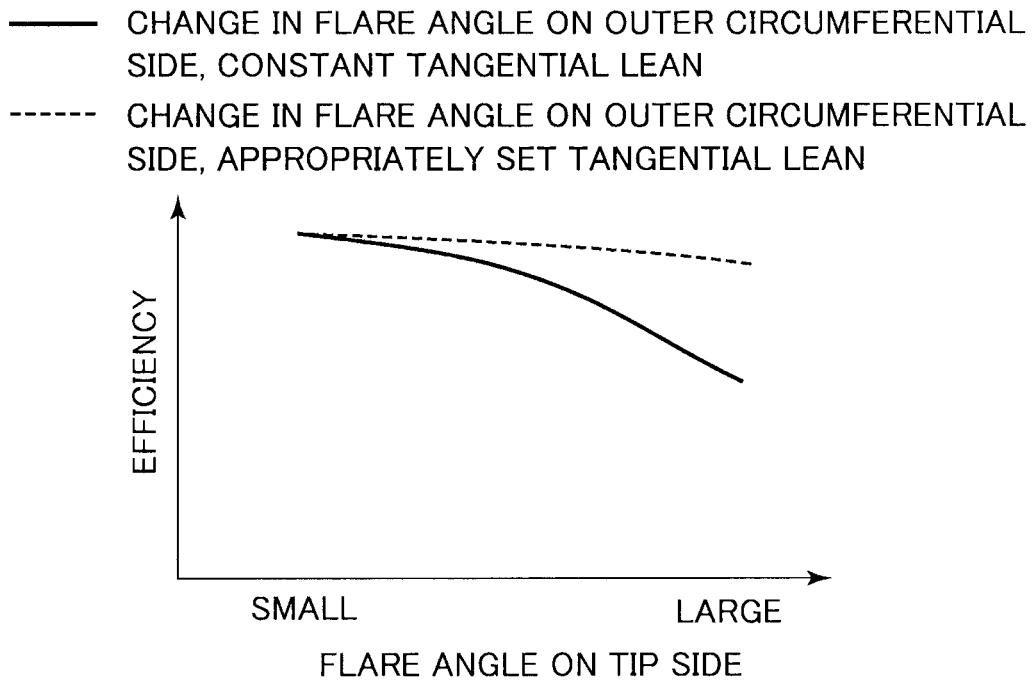
FIG. 3 is a graph of the relationship between a flare angle on a tip side and a stage efficiency.

FIG. 2 is a diagram illustrating the shape of the trailing edge of the stator vane 1 when the stator vane 1 is viewed from the downstream side in the axial direction of the shaft of the turbine. In FIG. 2, a broken line λ is a straight line that radially extends from a root portion of the trailing edge of the stator vane 1. A symbol δc.tip indicates a projecting amount of the trailing edge curved line from the broken line λ in the circumferential direction. In addition, a symbol γ is an inclination angle (Bow angle) of the trailing edge curved line with respect to the broken line λ in the circumferential direction. A symbol t.root indicates a pitch between the root portions of the stator vanes 1 that are adjacent to each other in the circumferential direction.

In the method for forming the tangential lean, a projecting amount standard value (δc.tip/t.root) is first determined so that the degree of reaction on the inner circumferential side is set to a pre-specified set value, and a base trailing edge curved line 9 (indicated by a broken line) of the tangential lean is generated. The base trailing edge curved line 9 is convex and half arched in the direction (indicated by an arrow of FIG. 2) of the rotation of the moving blade 2. The projecting amount of the trailing edge curved line in the rotational direction of the moving blade 2 monotonously increases toward the outer circumferential side of the turbine in the height direction of the stator vane 1. An inflection point is provided on the base trailing edge curved line 9 and located on the outer circumferential side with respect to the center of the stator vane 1 in the height direction of the stator vane 1. The trailing edge curved line 10 is formed so that a projecting amount of an outer circumferential portion (located on the outer circumferential side with respect to the inflection point) of the trailing edge curved line in the rotational direction of the moving blade 2 increases toward the outer circumferential side of the turbine in the height direction of the stator vane 1.

Next, the base trailing edge curved line 9 that is located on the inner circumferential side with respect to the inflection point, and the trailing edge curved line 10 that is located on the outer side circumferential side with respect to the inflection point, are connected to each other so as to form the tangential lean (indicated by a solid line).

In the present embodiment, the tangential lean of the stator vane 1, i.e., the trailing edge curved line, is inclined with respect to the rotational direction of the moving blade, and the projecting amount δc monotonously increases toward the tip portion of the stator vane 1 from the root portion of the stator vane 1 in the height direction of the stator vane 1. However, the increase rate of the projecting amount δc in the vicinity of the inflection point is reduced. The projecting amount δc on the outer circumferential side with respect to the inflection point increases again toward the tip portion of the stator vane 1. The projecting amount at the tip portion of the stator vane 1 is a value of (δc.tip+δc.tip').

In the present embodiment, the tangential lean, i.e., the trailing edge curved line is divided into the two lines at the inflection point. One of the two lines of the trailing edge curved line is located on the inner circumferential side and is convex and half arched in the rotational direction of the moving blade 2. The other of the two lines of the trailing edge curved line is located on the outer circumferential side and is convex and half arched in the opposite rotational direction of the moving blade 2. The other of the two lines of the trailing edge curved line may not be arched and curved. It is sufficient if the projecting amount of the other of the two lines (of the trailing edge curved line) in the rotational direction of the moving blade 2 monotonously increases toward the outer circumferential side in the height direction of the stator vane.

The stator vane 1 according to the present embodiment includes the trailing edge having the aforementioned curved line shape and has the following property.

In the present embodiment, as illustrated in FIG. 1, the outer circumferential side stator vane inner wall 6 is inclined toward the outer circumferential side of the turbine with respect to the direction from the upstream side of the flow of the working fluid to the downstream side of the flow of the working fluid, and the inner circumferential side stator vane inner wall 5 is inclined toward the inner circumferential side of the turbine with respect to the direction from the upstream side of the flow of the working fluid to the downstream side of the flow of the working fluid. Thus, the tip portion of the stator vane 1 is inclined toward the outer circumferential side of the turbine with respect to the axial direction of the turbine from the side of the leading edge 3 to the side of the trailing edge 4, and the root portion of the stator vane 1 is inclined toward the inner circumferential side of the turbine with respect to the axial direction of the turbine from the side of the leading edge 3 to the side of the trailing edge 4.

The inner circumferential side stator vane inner wall 5 of the stator vane 1 according to the present embodiment is inclined toward the inner circumferential side (side of the center of the rotor) of the turbine as described above. Comparing to the case in which the inclination angle $\alpha$ of the inner circumferential side stator vane inner wall 5 with respect to the axial direction of the turbine is 0 degrees, the inner and outer diameters of the stator vane 1 are large. As a result, the inclination angle (flare angle) of the outer circumferential side stator vane inner wall 6 with respect to the axial direction of the turbine is small. Thus, comparing to the case in which the inclination angle $\alpha$ is 0 degrees, radial flow of the working fluid at the stage is reduced, and a flow pattern in the radial direction can be improved. As a result, a profile loss of the moving blade due to the radial flow can be reduced. When the inclination angle $\alpha$ is excessively large, a profile loss of the moving blade may occur due to three-dimensional flow of the working fluid on the inner circumferential side at the moving blade. Therefore, it is preferable that the inclination angle $\alpha$ be in a range expressed by the following Formula 1.

$$0° < \alpha < 60° \quad \text{(Formula 1)}$$

In the present embodiment, the flare angle of the stator vane on the outer circumferential side can be reduced while a pitch between the stages is not large. Thus, an increase in the length of the shaft and an increase in the cost of the entire plant can be suppressed.

As described above, the inner circumferential side stator vane inner wall 5 (or the root portion of the stator vane 1) is inclined toward the inner circumferential side of the turbine rotor 17 (steam turbine) with respect to the direction of the flow of the working fluid from the upstream side to downstream side of the flow of the working fluid. However, according to design of the steam turbine, the positions 18 and 19 (hereinafter also referred to as minimum inter-vane flow path positions) (refer to FIG. 1) of the root portion and tip portion of the stator vane 1 are defined so that the width of an inter-vane flow path formed between the stator vane 1 and another stator vane, which are arranged adjacent to each other in the circumferential direction of the turbine rotor 17 (steam turbine), is minimal. When the distance between the minimum inter-vane flow path position 18 of the root portion of the stator vane 1 and the rotational center of the turbine rotor 17 (steam turbine) is increased, the distance between the minimum inter-vane flow path position 19 of the tip portion of the stator vane 1 and the rotational center of the turbine rotor 17 is also increased. Thus, the inclination angle of the tip portion of the stator vane 1 can be reduced. Therefore, the inclination of the inner circumferential side stator vane inner wall 5 on the upstream side with respect to the minimum inter-vane flow path position 18 does not need to be formed so that the inner diameter is reduced toward the downstream side of the flow of the working fluid in the flow direction of the working fluid, as described above. In order to reduce the inclination angle on the side of the tip portion of the stator vane 1, the minimum inter-vane flow path position 18 is located on the outer circumferential side of the steam turbine with the respect to the root portion of the moving blade 2 (i.e. the inner circumferential side moving blade inner wall 13); and the root portion of the stator vane 1 is inclined toward the inner circumferential side of the turbine rotor 17 with respect to the direction of the flow of the working fluid from the minimum inter-vane flow path position 18 to the downstream side of the flow of the working fluid.

In addition, the inflection point is provided on the trailing edge curved line and located on the outer circumferential side with respect to the center of the stator vane in the height direction of the stator vane, while the trailing edge curved line forms the tangential lean. The inner circumferential portion of the trailing edge curved line, which is located on the inner circumferential side with respect to the inflection point, forms the convex line and is arched on a pressure side of the stator vane (or in the rotational direction of the moving blade) so that the projecting amount of the inner circumferential portion of the trailing edge curved line monotonously increases toward the outer circumferential side from the inner circumferential side. Thus, the efficiency of increasing the degree of reaction is large on the inner circumferential side (on which the degree of reaction may be reduced).

In addition, the inflection point is provided on the trailing edge curved line 10 of the stator vane according to the present embodiment and located on the outer circumferential side with respect to the center of the stator vane 1 in the height direction of the stator vane 1, and the projecting amount increases again toward the outer circumferential side from the inflection point. The projection amount of the outer circumferential portion (located on the outer circumferential side with respect to the center of the stator vane in the height direction of the stator vane) of the trailing edge curved line less affects the degree of reaction on the inner circumferential side. Thus, the degree of reaction can be set to a desired degree on the basis of the inner circumferential portion (located on the inner circumferential side with respect to the inflection point) of the base trailing edge curved line. In other words, the degree of reaction on the inner circumferential side can be easily set to an appropriate degree on the basis of the projecting amount standard value ($\delta$c.tip/t.root).

The inventors of the present invention have paid attention to the fact that when the degree of reaction on the outer circumferential side of the turbine can be reduced by the tangential lean of the stator vane, supersonic inflow of the working fluid can be suppressed. Since the projecting amount monotonously increases again toward the outer circumferential side from the inflection point, a velocity component of the working fluid in an inner radial direction occurs at an outer circumferential portion of the stator vane. The degree of reaction on the outer circumferential side is reduced in the same principle as the aforementioned reduction in the degree of reaction on the inner circumferential side. Specifically, since the velocity component of the working fluid in the inner radial direction occurs at the stator vane outlet, intervals of an inner circumferential portion of a uniform flow diagram of a two-dimensional passage projected in a plane including a rotational axis are increased at the moving blade. As a result, in an inner circumferential portion of the turbine passage, a substantial passage area that corresponds to the moving blade is larger than a substantial passage area that corresponds to the stator vane. Thus, the degree of reaction, which is the ratio of a reduced amount of pressure at the moving blade to a reduced amount of pressure at the stage is reduced. When the degree of reaction is reduced, a heat drop between the front side of the stator vane and the back side of the stator vane increases, an outflow Mach number increases, and a relative inflow Mach number on the outer circumferential side of the moving blade is reduced. Specifically, the supersonic inflow at an inlet portion of the moving blade is reduced so that a profile loss of the moving blade due to a shock wave is reduced. As a result, the turbine efficiency is improved. Thus, when the stator vane according to the present embodiment is installed in the turbine stage provided with the moving blade that causes a moving blade outer circumferential end portion Mach number, which is obtained by dividing a rotational circumferential velocity of an outer circumferential inlet portion of the moving blade by a velocity of sound in the steam flowing into a region in which the outer circumferential end portion of the moving blade rotates, to be larger than 1.0, a profile loss due to a shock wave is suppressed, and the turbine efficiency is improved.

Figure 4A:
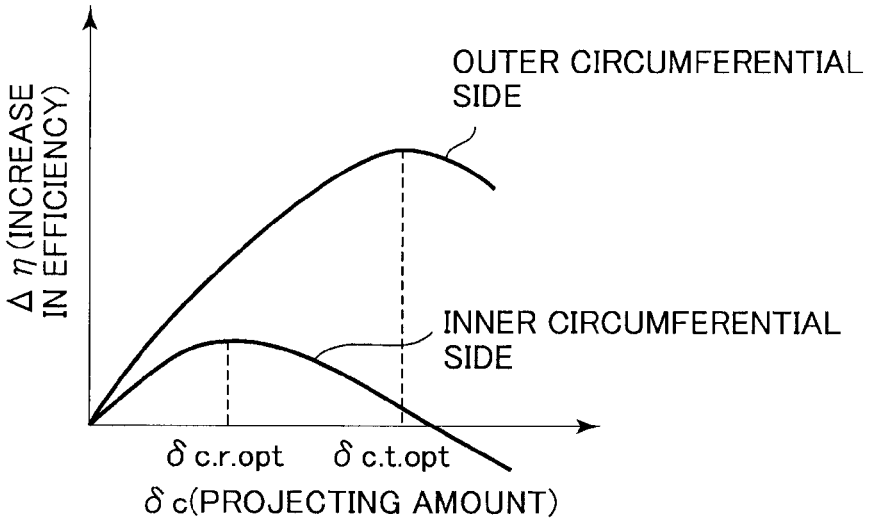
FIG. 4A is a graph in which a projecting amount of the stator vane and an increase in efficiency are plotted for each of inner and outer circumferential sides of the turbine.
Figure 4B:
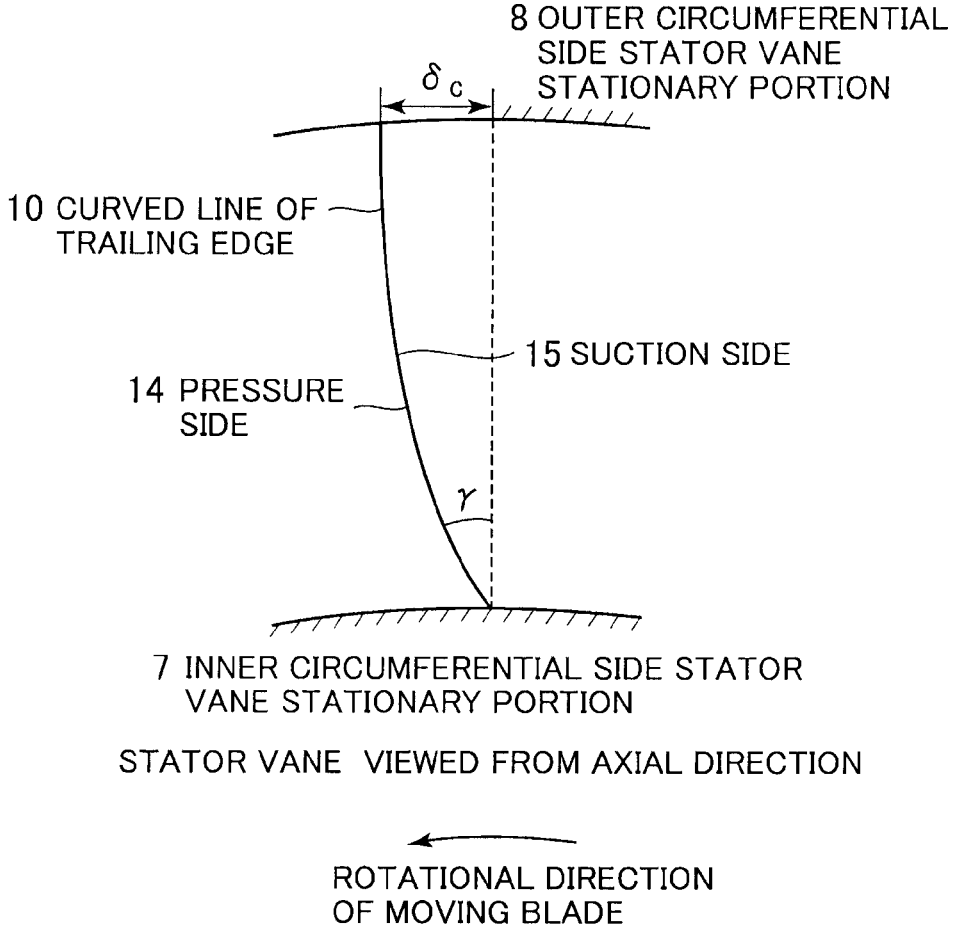
FIG. 4B is a diagram illustrating the shape of a curved line of a trailing edge of a stator vane when the stator vane is viewed from the downstream side in the axial direction of a turbine according to the conventional art.

FIG. 4A is a graph in which the projecting amount of the stator vane and an amount of an increase in the efficiency are plotted for each of the inner and outer circumferential sides when the relative inflow Mach number of the inlet portion of the moving blade is larger than 1.0. For a conventional stator vane, a projecting amount that corresponds to a peak amount of an increase in the efficiency on the inner circumferential side is equal to a projecting amount that corresponds to a peak amount of an increase in the efficiency on the outer circumferential side. However, the length of the moving blade according to the present invention is large, and a projecting amount that corresponds to a peak amount of an increase in the efficiency on the outer circumferential side is larger than a projecting amount that corresponds to a peak amount of an increase in the efficiency on the inner circumferential side. When the shape of a conventional tangential lean is used, the degrees of reaction on the inner and outer circumferential sides cannot be simultaneously set to the optimal values. On the other hand, when the shape of the tangential lean according to the present embodiment is used, the projecting amount of the trailing edge curved line on the inner circumferential side is set to an optimal value δc.r.opt, and the projecting amount of the trailing edge curved line on the outer circumferential side is set to an optimal value δc.t.opt, high efficiencies can be obtained on the inner and outer circumferential sides.

In the present embodiment, the inflection point is provided on the tangential lean, the projecting amount δc.tip monotonously increases toward the inflection point from the root portion in the height direction of the stator vane. In addition, the projecting amount increases again toward the outer circumferential end portion of the stator vane on the outer circumferential side with respect to the inflection point. Thus, the optimal projecting amount δc.r.opt on the inner circumferential side and the optimal projecting amount δc.t.opt on the outer circumferential side can be set so that the projecting amount that corresponds to the peak amount of the increase in the efficiency on the outer circumferential side is larger than the projecting amount that corresponds to the peak amount of the increase in the efficiency on the inner circumferential side. Therefore, high efficiencies can be achieved on the inner and outer circumferential sides.

When the steam turbine stator vane according to the present embodiment is used, it is possible to improve the flow pattern in the radial direction while the length of the moving blade is increased, easily set the degree of reaction on the inner circumferential side to an appropriate degree, and reduce a profile loss of the blade due to the radial flow without an increase in the length of the shaft of the turbine. In addition, when the steam turbine stator vane according to the present embodiment is used, it is possible to reduce the inflow Mach number on the outer circumferential side of the moving blade and suppress a profile loss of the moving blade due to a shock wave.

Thus, when the steam turbine stator vane according to the present embodiment is used, the turbine efficiency can be improved.

The moving blade may not be provided with the shroud cover. Even when the moving blade is not provided with the shroud cover, the effect described in the embodiment and the like are less changed.

As described above, the projecting amount of the trailing edge curved line of the stator vane 1 in the rotational direction of the moving blade when the stator vane 1 is viewed from the downstream side of the flow of the working fluid monotonously increases toward the tip portion of the stator vane 1 from the root portion of the stator vane 1. However, as illustrated in FIG. 2, it can be said that the projecting amount continuously increases toward the tip portion of the stator vane 1 from the root portion of the stator vane 1. Specifically, in the present embodiment, the increase in the projecting amount does not stop in a distance range from the root portion of the stator vane 1 to the tip portion of the stator vane 1, and the projecting amount is not constant in the entire distance range. Since the projecting amount continuously increases from the root portion of the stator vane 1 to the tip portion of the stator vane 1, the following can be said on the basis of a Bow angle at any point on the trailing edge curved line 10 of the stator vane 1.

Figure 5:
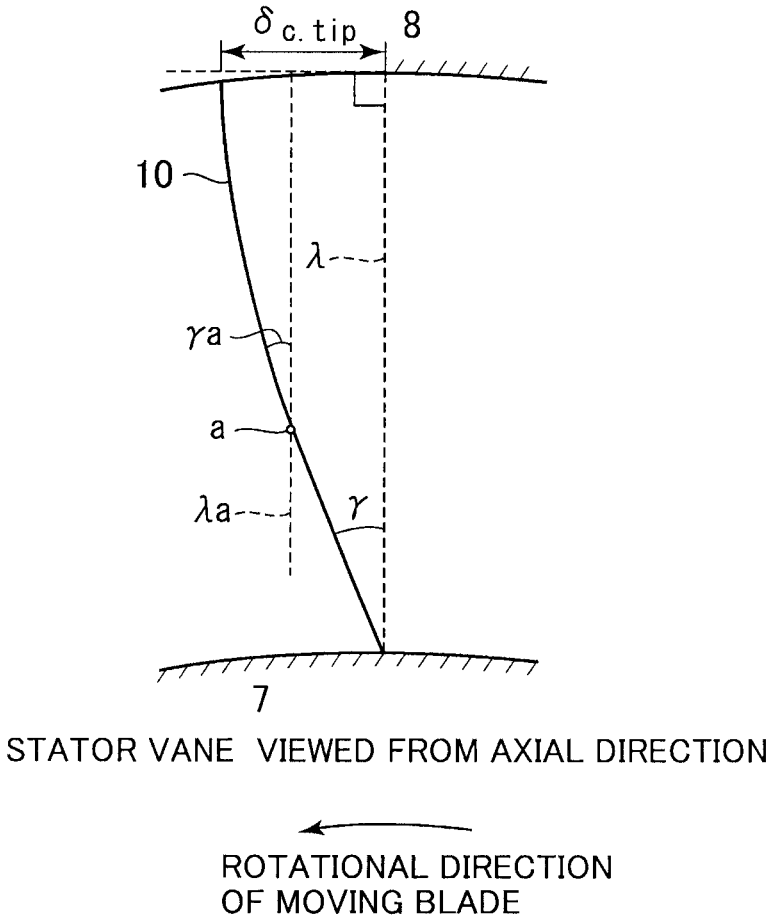
FIG. 5 is a diagram illustrating an increase in the projecting amount of the curved line of the stator vane according to the present invention in a rotational direction of a moving blade.

FIG. 5 is a diagram illustrating an increase in the projecting amount of the trailing edge curved line 10 of the stator vane 1 according to the present embodiment in the rotational direction of the moving blade. In FIG. 5, a point "a" is an arbitrary point on the trailing edge curved line 10, a broken line $\lambda a$ is a straight line (constant θ line) connecting the point "a" to the rotational center of the turbine rotor 17, and an angle γa is a Bow angle at the point "a" (the constant θ line is a broken line λ at an end point on the trailing edge curved line 10 and a Bow angle is an angle γ at the end point on the trailing edge curved line 10). As illustrated in FIG. 5, although the projecting amount continuously increases in the range from the root portion of the stator vane 1 to the tip portion of the stator vane 1, The Bow angle γa at any (arbitrary point "a") of all positions on the trailing edge curved line 10 are larger than zero. If the increase in the projecting amount stops at a certain point, a Bow angle at the certain point is zero. In the present embodiment, however, the Bow angles at all the positions on the trailing edge curved line 10 are larger than zero.

Since the projecting amount continuously increases in the range from the root portion of the stator vane 1 to the tip portion of the stator vane 1, a force that causes the working fluid to flow toward the inner circumferential side (inner circumferential side stator vane inner wall 5) of the turbine rotor 17 can act at all positions in the height direction of the stator vane 1. It is, therefore, possible to reduce a loss of secondary flow of the working fluid, compared to the case where a force acts on the working fluid at a part of all the positions in the height direction of the stator vane 1 (or where the increase in the projecting amount stops in a certain range).

By the way, when the inflection point provided on the tangential lean is located on the outer circumferential side with respect to the center of the stator vane in the height direction of the stator vane as described in the first embodiment, the degree of reaction on the inner circumferential side of the stator vane 1 and the degree of reaction on the outer circumferential side of the stator vane 1 can be independently controlled. Thus, there is a noticeable advantage that an increase in the number of processes for design of the stator vane can be suppressed. However, even if the inflection point is located on the inner circumferential side with respect to the center of the stator vane in the height direction of the stator vane, the efficiency of the turbine stage can be improved. Thus, from the perspective of the improvement in the efficiency of the turbine state, the position of the inflection point is not limited. This case is described as a modified example of the first embodiment with reference to FIG. 6.

Figure 6:
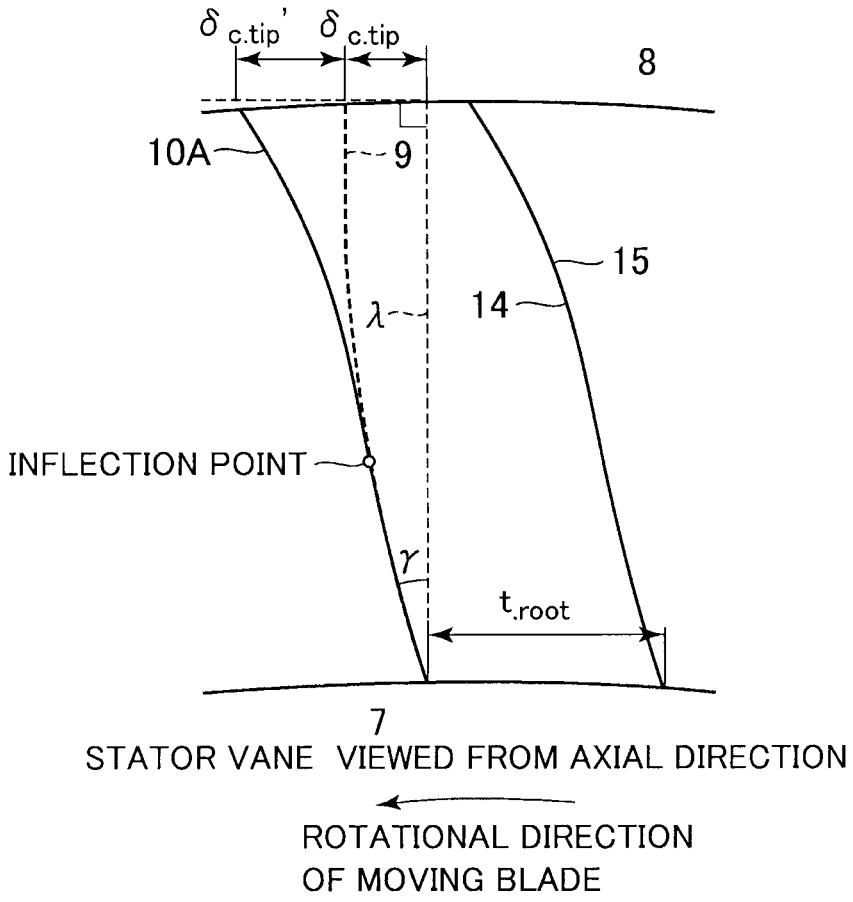
FIG. 6 is a meridian cross-sectional view of a main structure of a turbine stage according to a modified example of the first embodiment of the present invention.

FIG. 6 is a meridian cross-sectional view of a main structure of a turbine stage according to the modified example of the first embodiment of the present invention. Parts that are the same as the parts described in the first embodiment are indicated by the same reference numerals, and a description thereof is omitted. As illustrated in FIG. 6, an inflection point of a tangential lean is located on a trailing edge curved line 10A according to the modified example on the inner circumferential side with respect to the center of the stator vane in the height direction of the stator vane.

When a projecting amount δc.tip' on the outer circumferential side of the turbine rotor is increased, the degree of reaction on the outer circumferential side of the stator vane is reduced, and the supersonic flow of the working fluid into the region in which the moving blades rotate is suppressed. Thus, the efficiency of the turbine state is improved. However, when the projecting amount δc.tip' on the outer circumferential side of the turbine rotor is increased, a profile loss of the stator vane is increased due to secondary flow. Thus, when the projecting amount δc.tip' on the outer circumferential side of the turbine rotor exceeds the optimal value, the efficiency of the turbine state tends to be reduced.

On the other hand, when the position of the inflection point of the tangential lean is changed to a position on the inner circumferential side of the turbine rotor as described in the modified example, an effect of reducing the degree of reaction on the outer circumferential side in a wide range can be divided in the height direction of the stator vane 1, and an increase in the secondary flow due to the increase in the projecting amount δc.tip' on the outer circumferential side of the turbine rotor can be reduced. Thus, the efficiency of the turbine state can be improved. Other basic effects are the same as the first embodiment.

In the modified example, since the inflection point of the tangential lean is located on the inner circumferential side with respect to the center of the stator vane in the height direction of the stator vane, the projecting amount on the outer circumferential side also affects the degree of reaction on the inner circumferential side. Thus, the number of processes for design tends to increase, compared to the first embodiment in which the degree of reaction on the inner circumferential side and the degree of reaction on the outer circumferential side are independently controlled.

Second Embodiment

Figure 7:
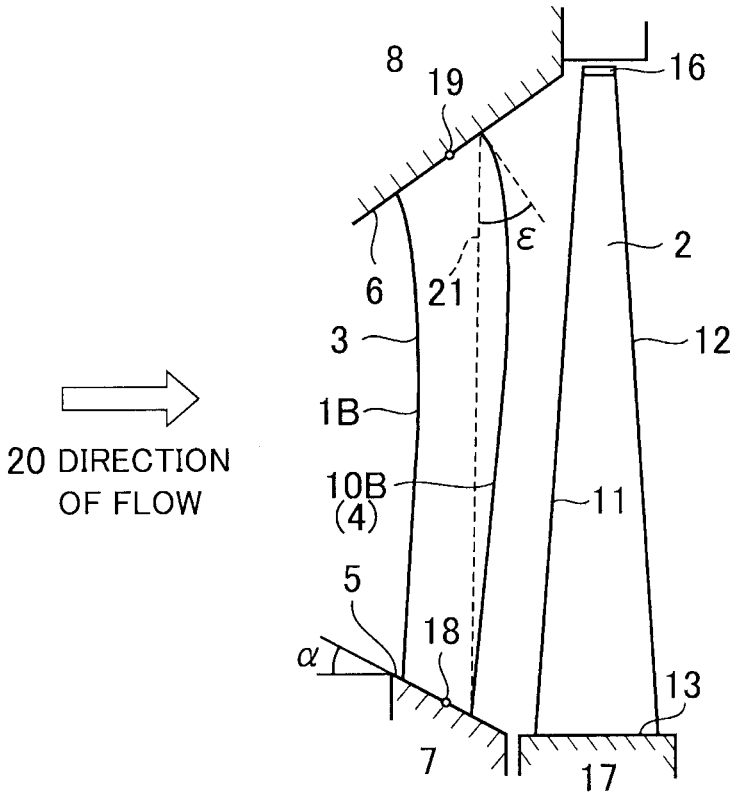
FIG. 7 is a meridian cross-sectional view of a main structure of a turbine stage according to a second embodiment of the present invention.

Next, a second embodiment of the present invention is described. FIG. 7 is a meridian cross-sectional view of a main structure of a turbine stage according to the second embodiment of the present invention. Constituent elements that are the same as the first embodiment are indicated by the same reference numerals, and a description thereof is omitted. The second embodiment is different from the first embodiment in a change (or axial lean) in the trailing edge curved line of the stator vane in the axial direction of the turbine rotor 17.

A steam turbine illustrated in FIG. 7 has a stator vane 1B. A curved line 10B is a curved line represented by rotationally projecting a trailing edge curved line of the stator vane 1B on a meridian surface (surface of the turbine rotor taken along the central axis of the turbine rotor (or the surface of the paper sheet of FIG. 7)) of the steam turbine. The curved line 10B is also called a "meridian surface curved line" for convenience. A straight line 21 is a line that connects both ends (tip portion and root portion of the stator vane 1B) of the meridian surface curved line 10B. As illustrated in FIG. 7, the straight line 21 according to the present embodiment and the meridian surface curved line 10B according to the present embodiment cross each other at the tip portion of the stator vane 1B so that the straight line 21 and the meridian surface curved line 10B form a predetermined angle (inclination angle ϵ) on the downstream side of the flow of the working fluid with respect to the straight line 21.

Figure 8B:
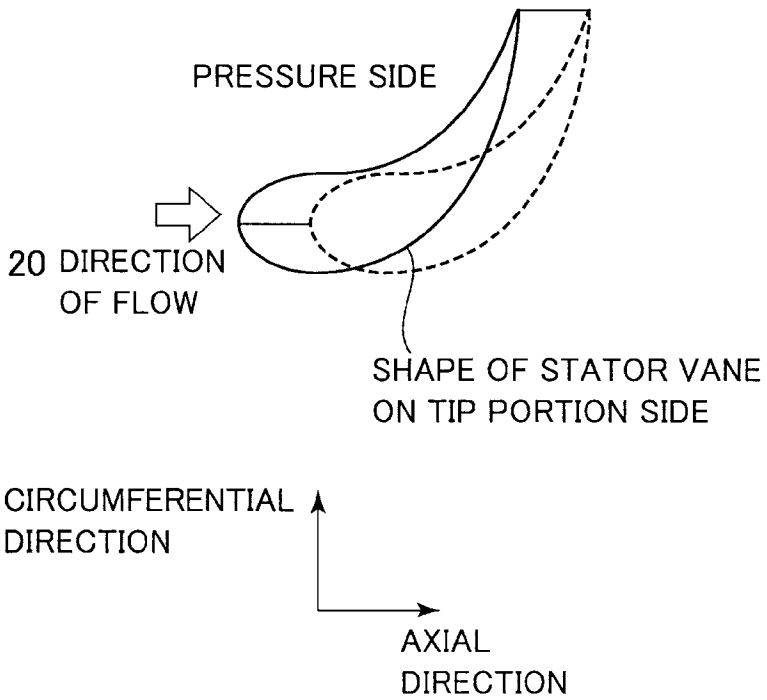
FIG. 8B is a diagram illustrating an axial lean of the stator vane according to the second embodiment of the present invention when the stator vane is viewed from the radial direction of the steam turbine.
Figure 8A:
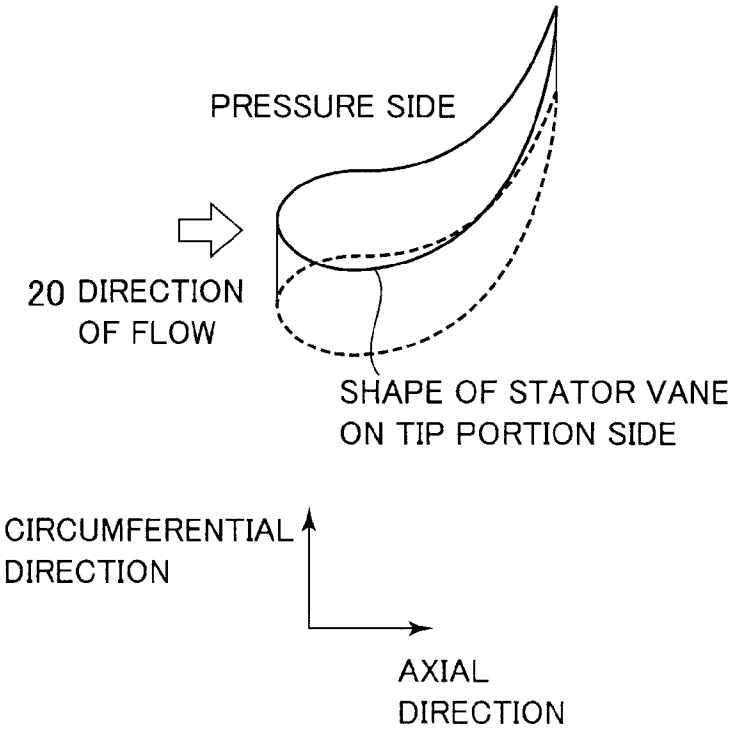
FIG. 8A is a diagram illustrating a tangential lean of a stator vane according to the second embodiment of the present invention when the stator vane is viewed from a radial direction of a steam turbine.

Effects of the tangential lean and the axial lean on the side of the tip portion of the stator vane 1B according to the present embodiment are described. The tangential lean on the side of the tip portion of the stator vane 1B according to the present embodiment is illustrated in FIG. 8A, while the axial lean on the side of the tip portion of the stator vane 1B according to the present embodiment is illustrated in FIG. 8B. Solid lines of FIGS. 8A and 8B each indicate the shape of the stator vane on the side of the tip portion, while broken lines of FIGS. 8A and 8B each indicate the shape of the stator vane on the side of the root portion. In addition, arrows 20 illustrated in FIGS. 8A and 8B indicate a flow direction of working steam. A "circumferential direction" that is illustrated in each of FIGS. 8A and 8B indicates a circumferential direction of the steam turbine, while an "axial direction" that is illustrated in each of FIGS. 8A and 8B indicates an axial direction of the steam turbine. A direction of an arrow that points in the "circumferential direction" illustrated in each of FIGS. 8A and 8B matches the rotational direction of the moving blade.

As illustrated in FIG. 8A, the tangential lean of the stator vane 1B is inclined in the circumferential direction on the side of the tip portion of the stator vane 1B and the pressure side in the same manner as the first embodiment, and a projecting amount of the tangential lean in the rotational direction of the moving blade increases toward the tip portion of the stator vane 1B. As illustrated in FIG. 8B, the axial lean of the stator vane 1B is inclined in the axial direction on the side of the tip portion of the stator vane 1B and the pressure side and forms the inclination angle ϵ with the straight line 21 on the downstream side of the flow of the working steam in the flow direction 20 of the working steam (working fluid). When attention is focused on the inclination (excluding the tip portion) in the height direction of the stator vane 1B on the pressure side, the inclination angle of a first half of the tangential lean of the stator vane 1B is large, and the inclination angle of a second half of the axial lean of the stator vane 1B is large. Specifically, the tangential lean causes a force to act on the working steam on the side of the root portion and the upstream side of the stator vane 1B. In addition, the axial lean causes a force to act on the working steam on the side of the root portion and the downstream side of the stator vane 1B.

In the present embodiment, the reduction in the degree of reaction on the outer circumferential side of the stator vane and the suppression of the supersonic inflow are achieved by combining the tangential lean of the stator vane with the axial lean of the stator vane. In conjunction with the trailing edge curved line of an outer circumferential part of the stator vane 1B, the stator vane 1B is formed so that the projection amount in the circumferential direction of the turbine rotor and the projection amount in the axial direction of the turbine rotor increase toward the outer circumferential side of the turbine rotor. Thus, a velocity component of the working steam in an inner diameter direction occurs around the outer circumferential part of the stator vane 1B, and whereby the degree of reaction on the outer circumferential side can be reduced by the same principle as described in the first embodiment. In addition, the supersonic flow of the working steam into the region in which the moving blades rotate is suppressed. Thus, it is possible to reduce a profile loss that is caused by a shock wave. As a result, the turbine efficiency can be improved. When the stator vane according to the present embodiment is installed in the turbine stage provided with the moving blade that causes the moving blade outer circumferential end portion Mach number (which is obtained by dividing the rotational circumferential velocity of the outer circumferential inlet portion of the moving blade by the velocity of sound in the steam flowing into a region in which the outer circumferential end portion of the moving blade rotates) to be larger than 1.0, a profile loss due to a shock wave is suppressed, and the turbine efficiency is improved.

As described above, the tangential lean and the axial lean have an effect of reducing the degree of reaction on the side (outer circumferential side) of the tip portion of the stator vane. Thus, in the second embodiment in which the tangential lean and the axial lean are combined, the projecting amount of the tangential lean is smaller, compared to the first embodiment in which the tangential lean is independently provided. Thus, a profile loss due to the secondary radial flow can be reduced in the second embodiment in which the radial flow is generated by the leading edge and trailing edge of the stator vane, compared to the first embodiment in which the radial flow is generated by the leading edge of the stator vane.

A flow pattern in the radial direction can be improved by the thus-configured steam turbine stator vane according to the present embodiment even when the lengths of the blades are increased. In addition, the degree of reaction on the inner circumferential side of the stator vane can be set to an appropriate degree, and a profile loss due to the radial flow and the like can be reduced without an increase in the length of the shaft of the turbine. Furthermore, it is possible to reduce the inflow Mach number on the outer circumferential side of the moving blade and suppress a profile loss that is caused by a shock wave.

Thus, the turbine efficiency can be improved by the steam turbine stator vane according to the present embodiment.

The moving blade may not be provided with the shroud cover. Even when the moving blade is not provided with the shroud cover, the effect described in the embodiment and the like are less changed.

What is claimed is:

1. A steam turbine stator vane, comprising:

a trailing edge having a curved line on which an inflection point is provided when the stator vane is viewed from a downstream side in a flow direction of a working fluid in an axial direction of a steam turbine;

an outer circumferential stator vane end portion that is inclined at a flare angle toward an outer circumferential tip side of a moving blade of the steam turbine with respect to the flow direction of the working fluid from an upstream side to the downstream side; and an inner circumferential stator vane end portion that is inclined toward an inner circumferential root side of the moving blade of the steam turbine from a position at which a width of an inter-vane flow path formed between the stator vane and another stator vane is minimal to the downstream side of the flow direction of the working fluid, with the stator vane and the other stator vane being arranged adjacent to each other in a circumferential direction of the steam turbine, wherein a projecting amount of the trailing edge forms a curved line and, in a rotational direction of the moving blade of the steam turbine, monotonously increases from the inner circumferential end portion of the stator vane to the outer circumferential portion of the stator vane.

2. The steam turbine stator vane according to claim 1, wherein the inflection point is located on the outer circumferential side of the steam turbine with respect to the center of the stator vane in the height direction of the stator vane.

3. The steam turbine stator vane according to claim 1, wherein an inner circumferential part of the trailing edge curved line is located on the inner circumferential side of the steam turbine with respect to the inflection point of the trailing edge curved line and is convex and half arched in the rotational direction of the moving blade when the stator vane is viewed from the downstream side of the flow of the working fluid in the axial direction of the steam turbine.

4. The steam turbine stator vane according to claim 1, wherein when a curved line that is represented by rotationally projecting the trailing edge curved line on a meridian surface of the steam turbine is regarded as a meridian surface curved line, the meridian surface curved line and a straight line connecting both ends of the meridian surface curved line cross each other at the outer circumferential end portion of the stator vane so that the meridian surface curved line and the straight line form a predetermined angle on the downstream side of the flow of the working fluid with respect to the straight line.

5. The steam turbine stator vane according to claim 1, wherein the stator vane forms a stage with the moving blade that causes a moving blade outer circumferential end portion Mach number to be larger than 1.0, while the moving blade outer circumferential end portion Mach number is obtained by dividing a rotational circumferential velocity of an outer circumferential inlet portion of the moving blade by a velocity of sound in steam flowing into a region in which an outer circumferential end portion of the moving blade rotates.

6. The steam turbine stator vane according to claim 1, wherein the stator vane is arranged at a last stage of a low-pressure turbine.

7. The steam turbine stator vane according to claim 1, wherein an inclination angle of the inner circumferential stator vane end portion with respect to the axial direction of the steam turbine is larger than 0° and smaller than 60° .

8. A steam turbine comprising:

a stage that includes a stator vane and a moving blade that faces the stator vane and is located on a downstream side of flow of a working fluid with respect to the stator vane, wherein the stator vane includes:

a trailing edge having a curved line on which an inflection point is provided when the stator vane is viewed from a downstream side in a flow direction of the working fluid in an axial direction of a steam turbine;

an outer circumferential stator vane end portion that is inclined at a flare angle toward an outer circumferential tip side of a moving blade of the steam turbine with respect to the flow direction of the working fluid from an upstream side to the downstream side; and an inner circumferential stator vane end portion that is inclined toward an inner circumferential root side of the moving blade of the steam turbine from a position at which a width of an inter-vane flow path formed between the stator vane and another stator vane is minimal to the downstream side of the flow direction of the working fluid, with the stator vane and the other stator vane being arranged adjacent to each other in a circumferential direction of the steam turbine, wherein a projecting amount of the trailing edge forms a curved line and, in a rotational direction of the moving blade of the steam turbine, monotonously increases from the inner circumferential end portion of the stator vane to the outer circumferential end portion of the stator vane.

9. The steam turbine according to claim 8, wherein the inflection point is located on the outer circumferential side of the steam turbine with respect to the center of the stator vane in the height direction of the stator vane.

10. The steam turbine according to claim 8, wherein an inner circumferential part of the trailing edge curved line is located on the inner circumferential side of the steam turbine with respect to the inflection point of the trailing edge curved line and is convex and half arched in the rotational direction of the moving blade when the stator vane is viewed from the downstream side of the flow of the working fluid in the axial direction of the steam turbine.

11. The steam turbine according to claim 8, wherein when a curved line that that is represented by rotationally projecting the trailing edge curved line on a meridian surface of the steam turbine is regarded as a meridian surface curved line, the meridian surface curved line and a straight line connecting both ends of the meridian surface curved line cross each other at the outer circumferential end portion of the stator vane so that the straight line and the meridian surface curved line form a predetermined angle on the downstream side of the flow of the working fluid with respect to the straight line.

12. The steam turbine according to claim 8, wherein a moving blade outer circumferential end portion Mach number that is obtained by dividing a rotational circumferential velocity of an outer circumferential inlet portion of the moving blade by a velocity of sound in steam flowing into a region in which an outer circumferential end portion of the moving blade rotates is larger than 1.0.

13. The steam turbine according to claim 8, wherein the stage is a last stage of a low-pressure turbine.

14. The steam turbine according to claim 8, wherein an inclination angle of the inner circumferential stator vane end portion with respect to the axial direction of the steam turbine is larger than 0° and smaller than 60° .

15. The steam turbine stator vane according to claim 2, wherein the stator vane forms a stage with the moving blade that causes a moving blade outer circumferential end portion Mach number to be larger than 1.0, while the moving blade outer circumferential end portion Mach number is obtained by dividing a rotational circumferential velocity of an outer circumferential inlet portion of the moving blade by a velocity of sound in steam flowing into a region in which an outer circumferential end portion of the moving blade rotates.

16. The steam turbine stator vane according to claim 3, wherein the stator vane forms a stage with the moving blade that causes a moving blade outer circumferential end portion Mach number to be larger than 1.0, while the moving blade outer circumferential end portion Mach number is obtained by dividing a rotational circumferential velocity of an outer circumferential inlet portion of the moving blade by a velocity of sound in steam flowing into a region in which an outer circumferential end portion of the moving blade rotates.

17. The steam turbine stator vane according to claim 4, wherein the stator vane forms a stage with the moving blade that causes a moving blade outer circumferential end portion Mach number to be larger than 1.0, while the moving blade outer circumferential end portion Mach number is obtained by dividing a rotational circumferential velocity of an outer circumferential inlet portion of the moving blade by a velocity of sound in steam flowing into a region in which an outer circumferential end portion of the moving blade rotates.

18. The steam turbine stator vane according to claim 1, wherein a bow angle at any position on the trailing edge curved line is larger than zero.

19. The steam turbine according to claim 8, wherein a bow angle at any position on the trailing edge curved line is larger than zero.

* * * * *